US009561668B1

(12) United States Patent
Stangler et al.

(10) Patent No.: US 9,561,668 B1
(45) Date of Patent: Feb. 7, 2017

(54) USED TRANSFER LAYER DETECTION IN A TRANSFER PRINTING DEVICE

(71) Applicant: Assa Abloy AB, Stockholm (SE)

(72) Inventors: Jeffrey L. Stangler, Eden Prairie, MN (US); James Andrew Rieck, Brooklyn Park, MN (US); Tanya Jegeris Snyder, Edina, MN (US); Andrew Slotto, Crystal, MN (US); Lyndon James Hanson, Plymouth, MN (US); Jon Everett Freise, Minneapolis, MN (US)

(73) Assignee: Assa Abloy AB, Stockholm (SE)

( * ) Notice: Subject to any disclaimer, the term of this patent is extended or adjusted under 35 U.S.C. 154(b) by 0 days.

(21) Appl. No.: 15/067,429

(22) Filed: Mar. 11, 2016

(51) Int. Cl.
*B41J 33/00* (2006.01)
*B41J 2/325* (2006.01)

(52) U.S. Cl.
CPC ..... *B41J 2/325* (2013.01)

(58) Field of Classification Search
CPC ..... B41J 31/00; B41J 31/02; B41J 31/04; B41J 31/05; B41J 31/06; B41J 31/08; B41J 33/00; B41J 33/14; B41J 33/16; B41J 33/18; B41J 33/20; B41J 33/22; B41J 33/24; B41J 33/26; B41J 33/28; B41J 2/325
See application file for complete search history.

(56) References Cited

U.S. PATENT DOCUMENTS

| | | | | |
|---|---|---|---|---|
| 5,634,731 | A | 6/1997 | Kita et al. | |
| 7,417,656 | B1 * | 8/2008 | Holzschuh | B41J 33/00 347/217 |
| 2001/0046401 | A1 * | 11/2001 | Lien | B41J 33/00 400/240 |
| 2009/0278911 | A1 * | 11/2009 | Howell | B41J 31/05 347/262 |
| 2013/0032288 | A1 | 2/2013 | Lien et al. | |

FOREIGN PATENT DOCUMENTS

WO 2015191058 A1 12/2015

* cited by examiner

*Primary Examiner* — Kristal Feggins
(74) *Attorney, Agent, or Firm* — Westman, Champlin & Koehler, P.A.; Brian D. Kaul

(57) ABSTRACT

In a method of operating a transfer printing device, which includes a transfer ribbon having a series of transfer sections, a print unit, and a mark sensor, the transfer ribbon is fed in a feed direction. A transfer section that is available for printing is selected through the detection of an absence of a used mark in a predetermined position on the transfer ribbon corresponding to the transfer section using the mark sensor. An image is printed to the selected transfer section using the print unit. A used mark corresponding to the selected transfer section is printed in a predetermined position on the transfer ribbon.

13 Claims, 6 Drawing Sheets

USED TRANSFER LAYER DETECTION IN A TRANSFER PRINTING DEVICE

BACKGROUND

Credentials include identification cards, driver's licenses, passports, and other documents. Such credentials are formed from credential or card substrates including paper substrates, plastic substrates, cards and other materials. Such credentials generally include printed information, such as a photo, account numbers, identification numbers, and other personal information. Credentials can also include data that is encoded in a smartcard chip, a magnetic stripe, or a barcode, for example.

Credential production devices process credential substrates by performing at least one processing step in forming a final credential product. One such process is a transfer or lamination process that transfers a material to a surface of the card substrate using a heated transfer roller of a transfer unit of the device. This process can be used to transfer an image to the surface of the card substrate and/or provide protection to the surface of the card substrate from abrasion and environmental conditions, for example.

Intermediate transfer films or transfer ribbons include a fracturable laminate or transfer layer, which is often referred to as a "thin film laminate," that can be transferred to a surface of a card substrate using the heated transfer roller. Such transfer layers are generally continuous resinous materials that have been coated onto a continuous carrier layer or backing to form a transfer ribbon. The side of the resin material that is not attached to the continuous carrier layer is generally coated with a thermal adhesive which is used to create a bond between the resin and the surface of the substrate. The transfer roller is used to thermally activate the adhesive and press the resinous material against the surface of the substrate to bond the material to the surface. The carrier layer or backing is removed to complete the lamination process.

The transfer layer may also be in the form of a print intermediate, on which an image may be printed in a transfer printing process. In the transfer printing process, a print head is registered with a transfer section of the transfer layer using a registration mark on the transfer ribbon, and an image is printed to the transfer section using the print head. Next, the imaged transfer section is registered with the card substrate and/or the transfer roller using the registration mark corresponding to the imaged transfer section. The transfer roller is then used to activate the adhesive of the imaged transfer section causing the imaged transfer section to bond to the surface of the card substrate. The carrier layer or backing of the overlaminate material is then removed from the bonded imaged transfer section to complete the transfer of the image to the card substrate.

Once a transfer section of the transfer ribbon has been removed from the transfer ribbon, the transfer section is no longer useful in a transfer printing or lamination operation. Flaws occur in transfer printing and laminating operations when the credential production device uses a previously used transfer section, resulting in defects to the credential product.

SUMMARY

Embodiments of the present disclosure are directed to a transfer printing device and a method of operating the transfer printing device to avoid performing print and/or transfer operations on used or unavailable transfer sections.

In one embodiment of the method, the transfer printing device includes a transfer ribbon including a series of transfer sections, a print unit, and a mark sensor. In the method, the transfer ribbon is fed in a feed direction. A transfer section that is available for printing is selected through the detection of an absence of a used mark in a predetermined position on the transfer ribbon corresponding to the transfer section using the mark sensor. An image is printed to the selected transfer section using the print unit. A used mark corresponding to the selected transfer section is printed in a predetermined position on the transfer ribbon. In some embodiments, the imaged transfer section is transferred to a substrate using the transfer unit.

In accordance with another embodiment of the method, the candidate transfer section is detected using the mark sensor. The presence or absence of a used mark in a predetermined position corresponding to the candidate transfer section is detected. The transfer ribbon is fed in a feed direction and the detecting steps are repeated when the used mark is detected. The candidate transfer section is selected for printing when the absence of the used mark is detected. An image is printed to the selected transfer section using the print unit. A used mark corresponding to the selected transfer section is printed in a predetermined position on the transfer ribbon using the print unit.

Some embodiments of the transfer printing device include a controller, a mark sensor, and a print unit. The controller is configured to detect candidate transfer sections of a transfer ribbon by detecting a registration mark on the transfer ribbon that corresponds to the candidate transfer section. The controller is also configured to determine if the candidate transfer section is available for printing by detecting an absence of a used mark in a predetermined position relative to the candidate transfer section using the mark sensor. If the controller determines that the candidate transfer section is available for printing, the controller controls the print unit to print an image to the candidate transfer section, and to print a used mark in a predetermined position on the transfer ribbon relative to the candidate transfer section.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the Background.

DETAILED DESCRIPTION OF ILLUSTRATIVE EMBODIMENTS

Figure 1:
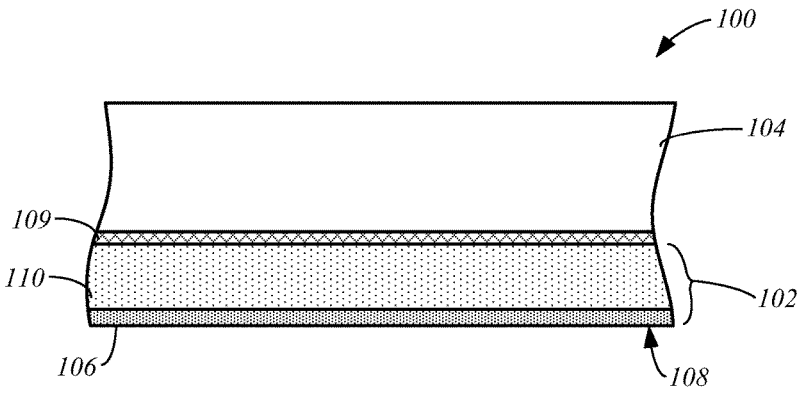
FIG. 1 is a simplified side cross-sectional view of an exemplary intermediate transfer film or transfer ribbon in accordance with embodiments of the present disclosure.

Embodiments of the present disclosure are described more fully hereinafter with reference to the accompanying drawings. Elements that are identified using the same or similar reference characters refer to the same or similar elements. The various embodiments of the present disclosure may, however, be embodied in many different forms and should not be construed as limited to the embodiments set forth herein. Rather, these embodiments are provided so that this disclosure will be thorough and complete, and will fully convey the scope of the present disclosure to those skilled in the art.

Specific details are given in the following description to provide a thorough understanding of the embodiments. However, it is understood by those of ordinary skill in the art that the embodiments may be practiced without these specific details. For example, circuits, systems, networks, processes, frames, supports, connectors, motors, processors, and other components may not be shown, or shown in block diagram form in order to not obscure the embodiments in unnecessary detail.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

It will be understood that when an element is referred to as being "connected" or "coupled" to another element, it can be directly connected or coupled to the other element or intervening elements may be present. In contrast, if an element is referred to as being "directly connected" or "directly coupled" to another element, there are no intervening elements present.

It will be understood that, although the terms first, second, etc. may be used herein to describe various elements, these elements should not be limited by these terms. These terms are only used to distinguish one element from another. Thus, a first element could be termed a second element without departing from the teachings of the present invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

As will further be appreciated by one of skill in the art, the present invention may be embodied as methods, systems, devices, and/or computer program products, for example. Accordingly, the present invention may take the form of an entirely hardware embodiment, or an embodiment combining software and hardware aspects. The computer program or software aspect of the present invention may comprise computer readable instructions or code stored in a computer readable medium or memory. Execution of the program instructions by one or more processors (e.g., central processing unit) results in the one or more processors performing one or more functions or method steps described herein. Any suitable patent subject matter eligible computer readable media or memory may be utilized including, for example, hard disks, CD-ROMs, optical storage devices, or magnetic storage devices. Such computer readable media or memory do not include transitory waves or signals.

The computer-usable or computer-readable medium may be, for example but not limited to, an electronic, magnetic, optical, electromagnetic, infrared, or semiconductor system, apparatus, device, or propagation medium. More specific examples (a non-exhaustive list) of the computer-readable medium would include the following: an electrical connection having one or more wires, a portable computer diskette, a random access memory (RAM), a read-only memory (ROM), an erasable programmable read-only memory (EPROM or Flash memory), an optical fiber, and a portable compact disc read-only memory (CD-ROM). Note that the computer-usable or computer-readable medium could even be paper or another suitable medium upon which the program is printed, as the program can be electronically captured, via, for instance, optical scanning of the paper or other medium, then compiled, interpreted, or otherwise processed in a suitable manner, if necessary, and then stored in a computer memory.

Embodiments of the present invention may also be described using flowchart illustrations and block diagrams. Although a flowchart may describe the operations as a sequential process, many of the operations can be performed in parallel or concurrently. In addition, the order of the operations may be re-arranged. A process is terminated when its operations are completed, but could have additional steps not included in a figure or described herein.

It is understood that one or more of the blocks (of the flowcharts and block diagrams) may be implemented by computer program instructions. These program instructions may be provided to a processor circuit, such as a microprocessor, microcontroller or other processor, which executes the instructions to implement the functions specified in the block or blocks through a series of operational steps to be performed by the processor(s) and corresponding hardware components.

FIG. 1 is a simplified side cross-sectional view of an exemplary intermediate transfer film or transfer ribbon 100 in accordance with embodiments of the present disclosure. In some embodiments, the transfer ribbon 100 includes a transfer layer 102 that is attached to a backing or carrier layer 104. The transfer layer 102 is configured to be transferred to a surface of a substrate through a transfer lamination process in accordance with embodiments of the present disclosure.

In some embodiments, the transfer layer 102 is in the form of a fracturable laminate or thin film laminate. In some embodiments, the transfer layer 102 includes an image receptive layer 106 that is configured to receive an image on the surface 108. The image may be printed to the surface 108 in accordance with conventional techniques, such as through dye sublimation or inkjet printing processes.

The transfer ribbon 100 may include other conventional layers or materials that are not shown in order to simplify the illustration. These include a thermal adhesive in the image receptive layer 106, or a thermal adhesive layer on the image receptive layer 106. The thermal adhesive is activated during a transfer lamination process to bond the transfer layer 102 to a substrate.

The transfer ribbon 100 may also include a release layer 109 between the transfer layer 102 and the carrier layer 104. The release layer simplifies the release of the transfer layer 102 from the carrier layer 104 during a transfer lamination process.

In some embodiments, the transfer layer 102 includes a protective layer 110 located between the image receptive layer 106 and the carrier layer 104. Alternatively, the protective layer 110 may be combined with the image receptive layer 106. In some embodiments, the protective layer 110 includes one or more resins. The protective layer 110 operates to provide protection to the surface on which the transfer layer 102 is laminated. The protective layer 110 will also protect an image printed on or in the image receptive layer 106 when the transfer layer 102 is laminated to the substrate.

Figure 2:
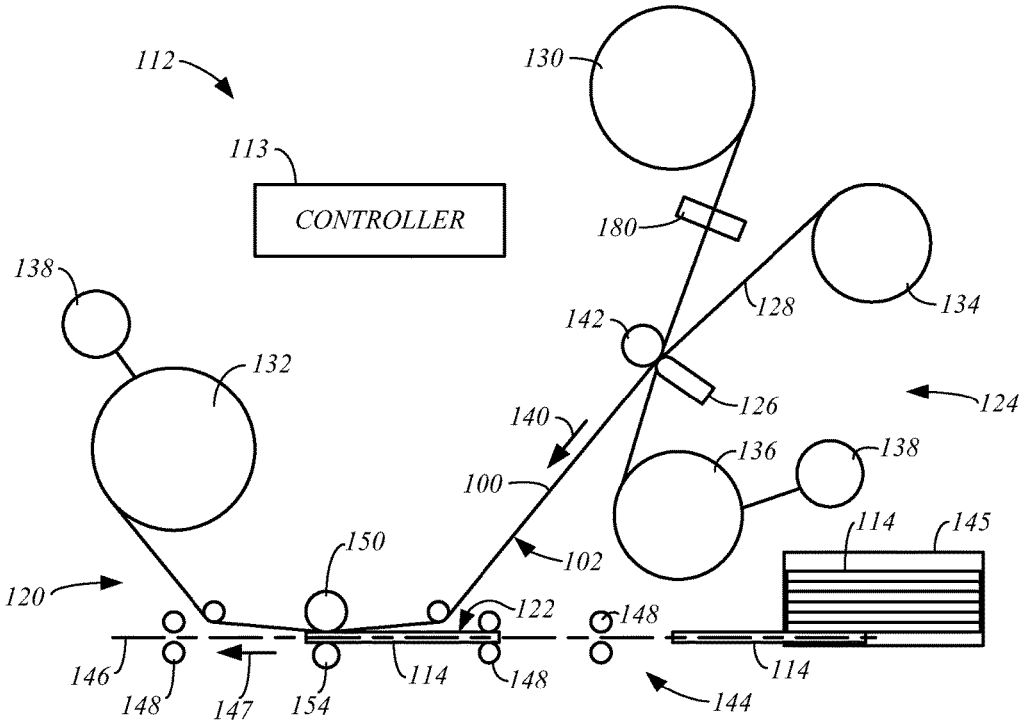
FIG. 2 is a simplified side view of an exemplary transfer printing device 112 in accordance with embodiments of the present disclosure.

FIG. 2 is a simplified side view of an exemplary transfer printing device 112 in accordance with embodiments of the present disclosure. Motors, gears, circuitry and other conventional components are not depicted in order to simplify the illustration.

In some embodiments, the device 112 includes a controller 113, which comprises at least one processor. In some embodiments, the controller 113 uses the at least one processor to execute program instructions stored in memory of the controller 113 or other memory, to control components of the device 112 to perform functions and method steps described herein to process a substrate 114.

The substrate 114 may take on many different forms, as understood by those skilled in the art. In some embodiments, the device 112 is in the form of a credential manufacturing device configured to produce credentials, such as driver's licenses, by processing a credential substrate 114 using the methods described herein. In some embodiments, the substrate 114 is a credential substrate. As used herein, the term "credential substrate" includes substrates used to form credentials, such as identification cards, membership cards, proximity cards, driver's licenses, passports, credit and debit cards, and other credentials or similar products. Exemplary card substrates include paper substrates other than traditional paper sheets used in copiers or paper sheet printers, plastic substrates, rigged and semi-rigged card substrates and other similar substrates.

In some embodiments, the device 112 includes a transfer unit 120 that is configured to transfer a portion (i.e., a transfer section) of the transfer layer 102 to a surface 122 of the substrate 114. In some embodiments, the device 112 includes a print unit 124, which is configured to print an image to the surface 108 of the image receptive layer 106 of the transfer section, before it is transferred to the surface 122 of the substrate 114 using the transfer unit 120.

In some embodiments, the print unit 124 includes a conventional thermal print head 126 comprising a plurality of heating elements that may be individually activated. In some embodiments, the print unit 124 includes a conventional thermal print ribbon 128, which may comprise a plurality of conventional print panels, such as colored dye panels, black resin panels, and/or other conventional print panels. Other printing devices, such as ink jet print heads, may also be used.

In some embodiments, the transfer ribbon 100 is supported between a supply spool 130 and a take-up spool 132, and the print ribbon 128 is supported between a supply spool 134 and a take-up spool 136. In some embodiments, the device 112 includes one or more motors 138 that are controlled by the controller 113 to drive rotation of the take-up spools 132 and 136 and feed the transfer ribbon 100 and the print ribbon 128 in a feed direction indicated by arrow 140, in accordance with conventional techniques. Other motors may be used to drive rotation of the supply spools 130 and 134 to reverse the feeding of the transfer ribbon 100 and the print ribbon 128.

The controller 113 controls the motors 138 to align or register a desired print panel of the print ribbon 128 with a transfer section of the transfer layer 102 before beginning a print operation. This may be accomplished using optical sensors, or using other conventional techniques. In some embodiments, a conventional mechanism drives the print head 126 to press the print ribbon 128 against the surface 108 of the transfer layer 102 under the support of a platen roller 142, as shown in FIG. 2. The heating elements of the print head 126 are then individually activated and deactivated as the print ribbon 128 and the transfer ribbon 100 are fed in the direction 140. This process may be repeated multiple times using different print panels of the print ribbon 128 to produce the desired image on or in the surface 108 of the image receptive layer 106 of the transfer section, in accordance with conventional techniques.

The imaged transfer section may then be transferred to the surface 122 of the substrate 114 by performing a transfer operation using the transfer unit 120. In some embodiments, the device 112 includes a conventional transport mechanism 144 and a substrate supply 145 (e.g., hopper or cartridge), which contains a plurality of the substrates 114. In some embodiments, the controller 113 controls the transport mechanism 144 to feed individual substrates 114 from the supply 145 along a processing path 146 in a feed direction 147. In some embodiments, the transport mechanism 144 includes motorized rollers 148, such as pinch roller pairs, or other conventional components to feed the cards 114 along the path 146.

In some embodiments, the transfer process begins by performing a conventional alignment process, in which the imaged transfer section of the transfer layer 102 is aligned with a substrate 114 that is presented to the transfer unit 120 along the processing path 146. In some embodiments, the controller 113 detects the positions of the substrate and the imaged transfer section using sensors, in accordance with conventional techniques. The controller 113 then controls the feeding of the transfer ribbon 100 using the motor 138, and the feeding of the substrate 114 along the path 146 using the transport mechanism 144, to align the imaged transfer section of the transfer layer 102 with the substrate 114 and complete the alignment process.

Figure 3:
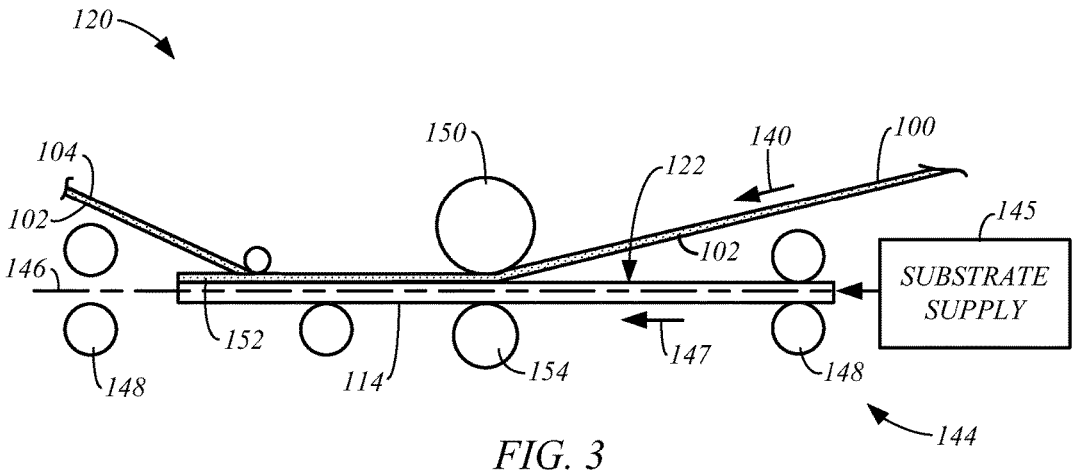
FIG. 3 is a simplified side view of an exemplary transfer unit performing a transfer operation in accordance with embodiments of the present disclosure.

In some embodiments, the transfer unit 120 includes a heated transfer roller 150 that is configured to transfer the imaged transfer section 152 to the surface 122 of the substrate 114, with which it has been aligned, as shown in the simplified side view of the transfer unit 120 provided in FIG. 3. During the transfer operation, the transfer roller 150 presses the imaged transfer section 152 against the surface 122 of the credential substrate 114, which is supported on a platen roller 154, and heats the transfer section 152 including the adhesive of the transfer layer 102 to bond the transfer section 152 to the surface 122 of the substrate 114.

The transfer roller 150 may be substituted by alternative laminating devices. In some embodiments, element 150 represents a laminating device comprising multiple heating elements. During a transfer operation, the laminating device selectively heats portions of the imaged transfer section 152 to bond only the heated portions to the substrate 114. Thus, in some embodiments, only select portions of the imaged transfer section 152 are bonded to the substrate 114. An example of such a laminating device is described in U.S. Publication No. 2013/0032288, which is hereby incorporated by reference in its entirety.

As the substrate 114 and the transfer ribbon 100 are fed past the transfer roller 150, the carrier layer 104 is peeled from the transfer section 152, or portion thereof, that has bonded to the surface 122. Portions of the transfer section 152 and the transfer layer 102 that do not bond to the surface 122, such as, for example, portions of the transfer layer 102 located along the sides of the transfer section 152, remain adhered to the carrier layer 104, as indicated in FIG. 3. After the imaged transfer section 152 has been transferred from the ribbon 100 to the surface 122 of the substrate 114, the processed substrate 114 may be discharged from the device 112 and into a hopper, for example.

Figure 4:
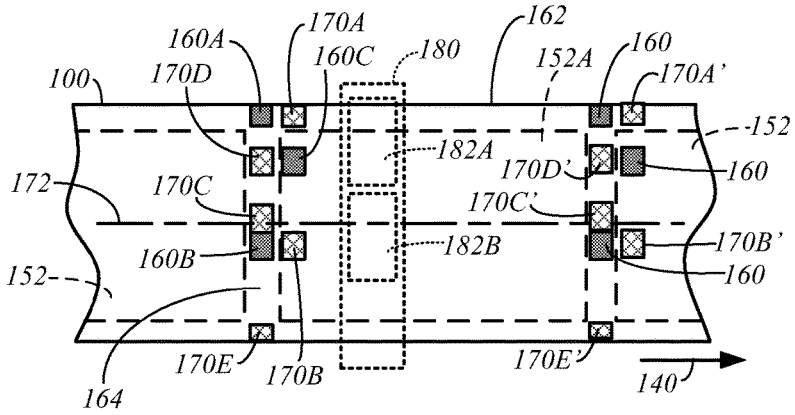
FIG. 4 is a simplified top plan view of a portion of an exemplary intermediate transfer ribbon in accordance with exemplary embodiments of the present disclosure.

FIG. 4 is a simplified top plan view of a portion of an intermediate transfer ribbon 100 in accordance with exemplary embodiments of the present disclosure. In some embodiments, each of the transfer sections 152 (illustrated in phantom lines) includes one or more corresponding alignment or registration marks, generally referred to as marks 160, on the transfer ribbon 100. In some embodiments, the alignment marks 160 are formed at the time the transfer ribbon 100 is manufactured. That is, the transfer ribbon 100 includes the marks 160 before the transfer ribbon 100 is installed in the device 112.

The marks 160 are each located at a predetermined position on the transfer ribbon 100 relative to their corresponding transfer section 152. The controller 113 determines or detects the position of each of the transfer sections 152 through the detection of the corresponding mark or marks 160. In some embodiments, the device 112 includes an optical sensor that is used by the controller 113 to detect the marks 160 on the transfer ribbon 100. The controller 113 uses the detection of the marks 160 to control the feeding of the transfer ribbon 100 and to align the transfer sections 152 with the desired component of the device, such as a panel of the print ribbon 128, the print head 126, the transfer roller 150, or other component of the device 112.

The alignment marks may be formed at various locations on or within the transfer ribbon 100. In some embodiments, the alignment marks 160 are formed on or in the intermediate transfer layer 102, such as on or in the image receptive layer 106, or on or in the protective layer 110. In some embodiments, the alignment marks 160 are formed on or in the carrier layer 104. In some embodiments, the alignment marks 160 are formed on or in the release layer 109. Most commonly, the marks 160 are formed between the transfer layer 102 and the carrier layer 104.

The alignment marks 160 may comprise markings of various forms that may be detected by the optical sensor of the device 112. In some embodiments, the alignment marks 160 are colored marks that block or reflect visible light. In some embodiments, the alignment marks 160 are configured to block or reflect infrared light, such as described in international publication number WO 2015/191058 A1, which is incorporated herein by reference in its entirety.

The transfer ribbon 100 of FIG. 4 illustrates a variety of exemplary predetermined positions of the one or more marks 160 within the plane of the transfer ribbon that correspond to each of the transfer sections 152. In some embodiments, the registration marks 160 include a registration mark 160 that is located adjacent a side edge 162 of the transfer ribbon 100, such as illustrated by exemplary registration mark 160A in FIG. 4. In some embodiments, the registration marks 160 include at least one registration mark 160 that is located within a gap 164 between adjoining transfer sections 152, as illustrated by exemplary registration marks 160A and 160B. In some embodiments, the registration marks 160 include one or more registration marks 160 that are located within the corresponding transfer section 152, as illustrated by exemplary registration mark 160C.

Following a transfer operation, in which an imaged transfer section 152 or portion thereof, is bonded to the substrate 114 and removed from the transfer ribbon 100, the portion of the transfer ribbon 100 corresponding to the removed transfer section 152 is no longer available for use by the device 112 to perform a transfer operation. When the device 112 attempts to perform a print and/or transfer operation using such unavailable transfer sections, the printing and/or transfer operation will likely be flawed, resulting in a defective transfer print operation and possibly a malfunction of the device 112. Unfortunately, conventional transfer printers are incapable of determining whether a transfer section 152 that is detected using one of the registration or alignment marks 160 is available for a print and/or transfer operation, or whether the transfer section 152 has already been used in a printing and/or transfer operation rendering it unavailable for use. As a result, errors and defective transfer print operations can occur, such as when a used transfer ribbon 100 is installed into the transfer printer. Embodiments of the present disclosure operate to prevent such errors by detecting used or unavailable transfer sections 152 before performing a print or transfer operation.

In some embodiments, before or after printing an image to a transfer section 152, one or more used marks, each generally referred to as used mark 170, are printed to the transfer ribbon 100 in a predetermined location relative to the transfer section 152 using the print unit 124. As discussed below in greater detail, during a print operation, the controller 113 attempts to detect the presence or absence of a used mark 170 in the predetermined position relative to a candidate transfer section 152. The controller 113 commences with the print operation on the candidate transfer section 152 if the absence of a used mark is detected in the predetermined position, and the controller skips performing the print operation on the candidate transfer section 152 if a used mark is detected in the predetermined position. In some embodiments, the detection of the presence or absence of a used mark 170 is accomplished using a suitable optical sensor, as discussed below.

The used marks 170 may be printed at various locations on the intermediate transfer layer 102 of the transfer ribbon 100 using the print unit 124. The transfer ribbon 100 of FIG. 4 illustrates a variety of exemplary predetermined positions relative to a used or unavailable transfer section 152A for the one or more used marks 170.

In some embodiments, the one or more used marks 170 corresponding to the used or unavailable transfer section 152A are located on a downstream side of the transfer section 152A relative to the feed direction 140, such as illustrated by used marks 170A-E. In some embodiments, the one or more used marks 170 corresponding to the used or unavailable transfer section 152A are located on an upstream side of the transfer section 152A relative to the feed direction 140, such as illustrated by used marks 170A'-E'. The upstream side used marks 170 (e.g., 170A'-E') may be formed in accordance with one or more of the embodiments of the downstream side marks (e.g., 170A-E) described below.

Some embodiments of the used marks 170 include a used mark that is positioned adjacent the registration mark 160 corresponding to the unavailable transfer section 152A, such as illustrated by the pairs of marks 160A and 170A, marks 160B and 170B, marks 160B and 170C, and marks 160C and 170D, for example. In some embodiments, such pairs of the marks 160 and 170 position the mark 160 on an upstream side of the corresponding mark 170 relative to the feed direction 140, such as illustrated by pairs of marks 160A and 170A, and marks 160B and 170B, for example. In some embodiments, such pairs of the marks 160 and 170 position the mark 160 on a downstream side of the corresponding mark 170 relative to the feed direction 140, such as illustrated by the pair of marks 160C and 170D, for example. In some embodiments, the corresponding marks 160 and 170 may be displaced from each other in a direction that is perpendicular to a central or longitudinal axis 172 of the ribbon 100, such as illustrated by used marks 170B, 170C, 170D and 170E relative to the registration mark 160A, for example. In some embodiments, the used mark 170 is located proximate to the central or longitudinal axis 172, such as illustrated by exemplary used marks 170B and 170C, for example. In some embodiments, the used mark 170 is located on an opposing edge of the transfer ribbon 100 from the corresponding registration mark 160, such as illustrated by marks 160A and 170E, for example. In some embodiments, the used marks 170 are printed outside of the corresponding transfer section 152A, such as within the gap 164, as illustrated by exemplary marks 170C, 170D and 170E, for example. In some embodiments, the used marks are printed within the corresponding transfer section 152A, such as illustrated by exemplary mark 170B. This option is generally available when a portion of the transfer section 152A is not transferred to the substrate 114 during the transfer operation, or when a non-visible print material is applied to the transfer ribbon 100 by the print unit 124 to form the used mark 170. Other positions for the one or more used marks 170 that are printed to the transfer ribbon 100 using the print unit 124 may also be used.

Embodiments of the device 112 include one or more optical sensors that are used by the controller 113 to detect the registration marks 160 and the used marks 170. As mentioned above, the detection of the registration marks 160 allows the controller 113 to detect the position of a transfer section 152, and align the transfer section 152 to the print unit 124 before commencing a print operation. This may involve aligning the transfer section to a print panel of the print ribbon 128 in accordance with conventional techniques. The detection of the used marks 170 allows the controller 113 to determine if a candidate transfer section 152 is unused and available for the print operation, or if the candidate transfer section 152 is used and is unavailable for the print operation.

In some embodiments, the device 112 includes a mark sensor 180 that is configured to detect both the registration marks 160 and the used marks 170 on the transfer ribbon. In some embodiments, the mark sensor 180 is positioned upstream of the print head 126 relative to the feed direction 140 of the transfer ribbon 100, as shown in FIG. 2. The mark sensor 180 may alternatively be located downstream of the print head 126 relative to the feed direction 140.

Figure 5:
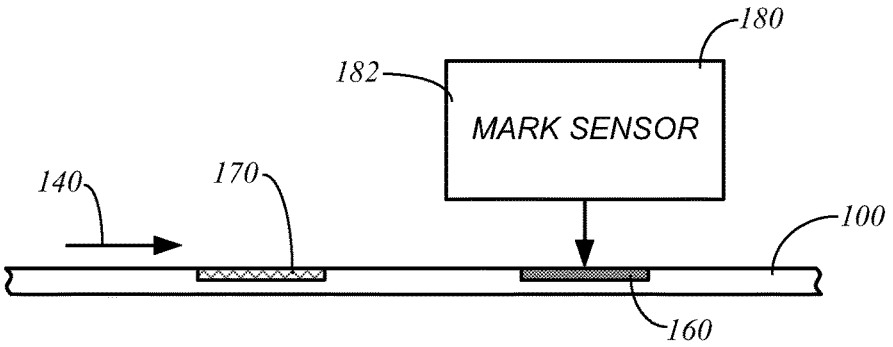
FIGS. 5 and 6 are simplified side views of a mark sensor and a portion of the transfer ribbon in accordance with embodiments of the present disclosure.
Figure 6:
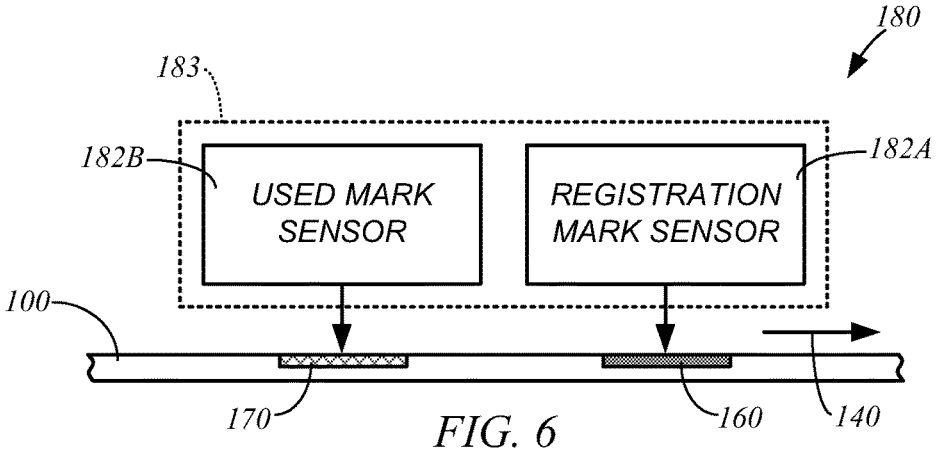

In some embodiments, the mark sensor 180 includes a single optical sensor 182 for detecting both the registration marks 160 and the used marks 170, as shown in the simplified side view of FIG. 5, or separate optical sensors 182A and 182B for detecting the registration marks 160 (registration mark sensor 182A) and the used marks (used mark sensor 182B), respectively, as shown in the simplified side view of FIG. 6. The optical sensors 182A and 182B are respectively referred to as the registration mark sensor and the used mark sensor. When the mark sensor 180 includes the registration mark sensor 182A and the used mark sensor 182B, the sensor 180 may include a housing 183 (shown in phantom lines) that supports both of the sensors 182A and 182B adjacent the transfer ribbon 100. Alternatively, the sensors 182A and 182B may be formed as separate sensors that are each supported by separate housings.

When the mark sensor 180 includes the single optical sensor 182 (FIG. 5), it is capable of detecting the marks 160 and 170 at different moments in time as the transfer ribbon 100 is fed in the feed direction 140. When the mark sensor 180 includes the registration mark sensor 182A and the used mark sensor 182B, the registration marks 160 and the corresponding used marks 170 may be detected simultaneously as the transfer ribbon 100 is fed in the feed direction 140. For example, the registration mark sensor 182A and the used mark sensor 182B may be displaced from each other in a direction that is perpendicular to the longitudinal axis 172, as illustrated in phantom lines in FIG. 4. This configuration allows the sensors 182A and 182B to simultaneously detect the corresponding pair of marks 160 and 170, such as mark 160C and mark 170A or 170B, marks 160A and 160B and marks 170C, 170D or 170E, for example. Alternatively, the registration mark sensor 182A and the used mark sensor 182B may be displaced from each other along the longitudinal axis 172, as shown in the simplified side view of FIG. 6. In this configuration, the sensors 182A and 182B can be configured to simultaneously detect the registration mark 160 and the corresponding used mark 170 that are displaced from each other along the longitudinal axis 172, such as marks 160A and 170A, marks 160C and 170D, and marks 160B and 170B, shown in FIG. 4, for example.

Figure 7:
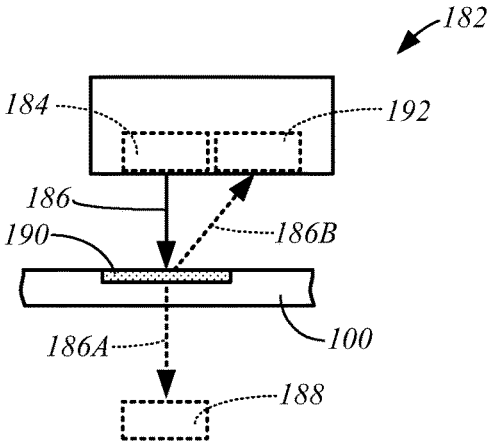
FIG. 7 is a simplified diagram of an exemplary optical sensor in accordance with embodiments of the present disclosure.

FIG. 7 is a simplified diagram of an optical sensor 182 that may be used to form the mark sensor 180 including the registration mark sensor 182A and/or the used mark sensor 182B. In some embodiments, the optical sensor 182 includes an emitter 184 that is configured to emit light 186 toward the transfer ribbon 100. The light 186 can take on any suitable form, such as visible light, infrared light, or other wavelength of light or electromagnetic energy.

In some embodiments, the sensor 182 operates as a transmissive sensor and includes a receiver 188 that is positioned on an opposing side of the transfer ribbon 100 from the emitter 184. In some embodiments, a mark 190 on the transfer ribbon 100, which represents a registration mark 160 or a used mark 170, is detected by detecting a change in the intensity of the light 186A, which is the portion of the light 186 that travels through the ribbon 100 and reaches the receiver 188, in accordance with conventional transmissive optical sensors.

Alternatively, the sensor 182 may be configured as a reflective sensor, and include a receiver 192 that is located on the same side of the transfer ribbon 100 as the emitter 184. In accordance with this embodiment, the mark 190 is detected in response to a change in the intensity of the reflected light 186B from the transfer ribbon 100 that occurs when the reflected light 186B reflects off the mark 190, in accordance with conventional reflective optical sensors. Thus, in some embodiments, the mark sensor 180 includes a single optical sensor 182 that is configured as either a transmissive optical sensor or a reflective optical sensor. Alternatively, the mark sensor 180 may include a registration mark sensor 182A that includes an optical sensor 182 that is configured as a transmissive optical sensor or reflective optical sensor, and a used mark sensor 182B that includes an optical sensor 182 that is configured as a transmissive optical sensor or a reflective optical sensor. In yet another alternative embodiment, the sensor 180 may include an optical sensor comprising two separate receivers (188 or 192) that are each used in the detection of a registration mark 160 or a used mark 170. Other configurations for the sensor 182 may also be used.

Figure 8:
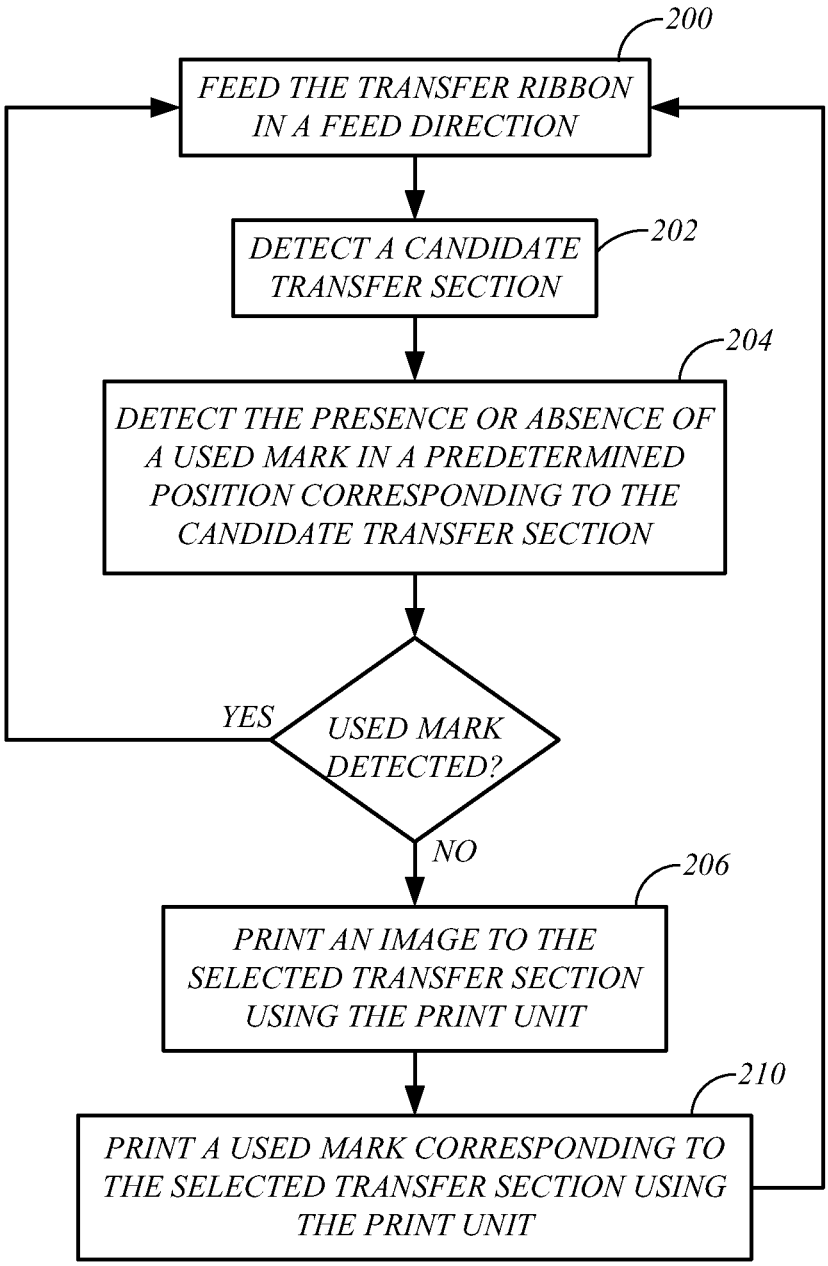
FIG. 8 is a flowchart illustrating methods of operating a transfer printing device in accordance with embodiments of the present disclosure.

FIG. 8 is a flowchart illustrating methods of operating the transfer printing device 112 in accordance with embodiments of the present disclosure. Embodiments of the method will also be described with reference to FIGS. 9-13, which are top plan views of an exemplary transfer ribbon 100, mark sensor 180, and print head 126, during various stages of operation of the device 112. While the exemplary transfer ribbon 100 illustrated in FIGS. 9-13 includes only a single registration mark 160 for each of the transfer sections 152, and a single used mark 170 for each of the used transfer sections, it is understood that each transfer section 152 may include one or more of the registration marks 160 and one or more of the used marks 170 (where applicable) in various predetermined locations relative to the transfer sections 152, as described above with reference to FIG. 4. Exemplary positions of the print head 126 or other printing device of the print unit 124, and the mark sensor 180 are shown in phantom lines in FIGS. 9-13.

At 200 of the method, the transfer ribbon is fed in the feed direction 140. At 202 of the method, during the feeding of the transfer ribbon 100, the controller 130 detects a candidate transfer section 152A through the detection of a corresponding registration mark 160A using the mark sensor 180. At 204 of the method, the controller 113 detects the presence or absence of a used mark 170 in a predetermined position corresponding to the candidate transfer section 152A, such as one or more of the exemplary predetermined positions illustrated in FIG. 4, for example. In the exemplary transfer ribbon 100 illustrated in FIG. 9, a used mark 170 is not located in the predetermined position relative to the candidate transfer section 152A. As a result, the controller 113 determines that the candidate transfer section 152A has not been subjected to a print or transfer operation by the transfer printing device 112, or another transfer printing device, and is, therefore, available for use in a printing operation. The controller 113 then selects or authorizes the candidate transfer section 152A for a print operation. At 206 of the method, an image 208A is printed to the selected transfer section 152A using the print unit 124 (e.g., print head 126) as the transfer ribbon 100 is fed in the feed direction 140, as indicated by shading in FIG. 10.

Figure 9:
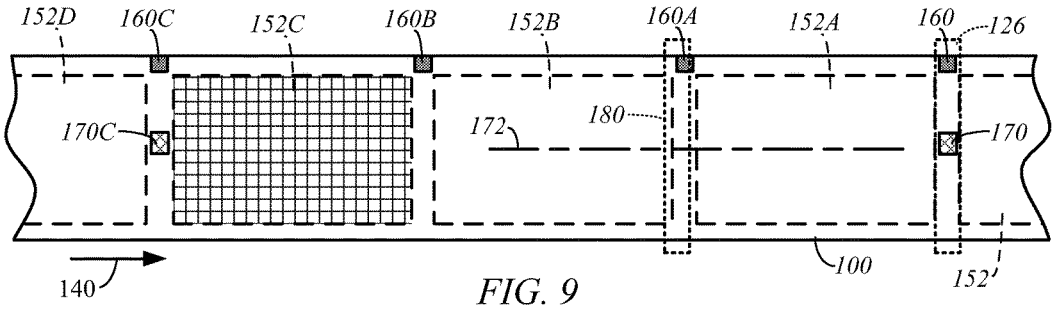
FIGS. 9-13 are top plan views of an exemplary transfer ribbon, a mark sensor, and a print head, of a transfer printing device during various stages of operation of the device, in accordance with embodiments of the present disclosure.
Figure 10:
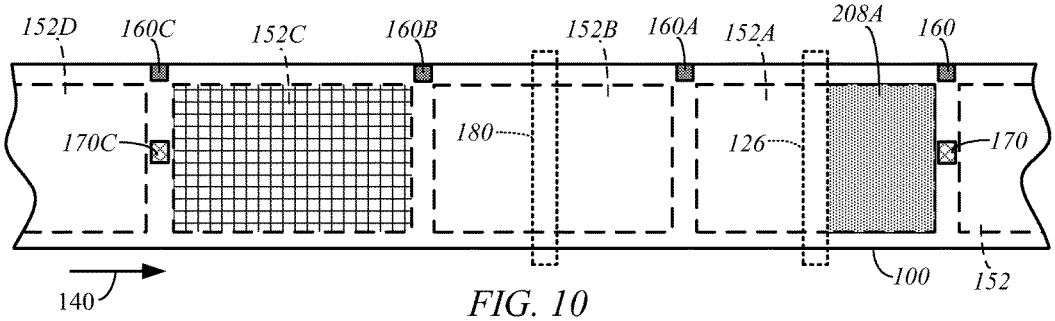

In some embodiments, the mark sensor 180 and the print head 126 of the print unit 124 are displaced from each other a fixed distance along the axis 172 of the transfer ribbon 100 that is approximately equal to a length of the transfer sections 152. In some embodiments, the detection of the registration mark 160A (and/or a used mark 170) by the mark sensor 180 occurs when the print head 126 is located at, or in close proximity to, a leading edge of the corresponding candidate transfer section 152, such as transfer section 152A, as illustrated in FIG. 9. Thus, the print operation may commence on the transfer section 152A upon detection of the corresponding registration mark 160 and/or the absence of the corresponding used mark 170.

Alternatively, the print head 126 may be positioned at a known distance upstream from the leading edge of the candidate transfer section 152 relative to the feed direction 140 upon detection of the corresponding registration mark 160 and/or the absence of the corresponding used mark 170 using the mark sensor 180. In this case, the controller 113 may feed the transfer ribbon 100 a fixed distance in the feed direction 140 following the detection of the mark 160 and/or the absence of the mark 170, to position the print head 126 at the leading edge of the candidate transfer section 152 and commence with the printing operation. Other configurations may also be used.

Figure 11:
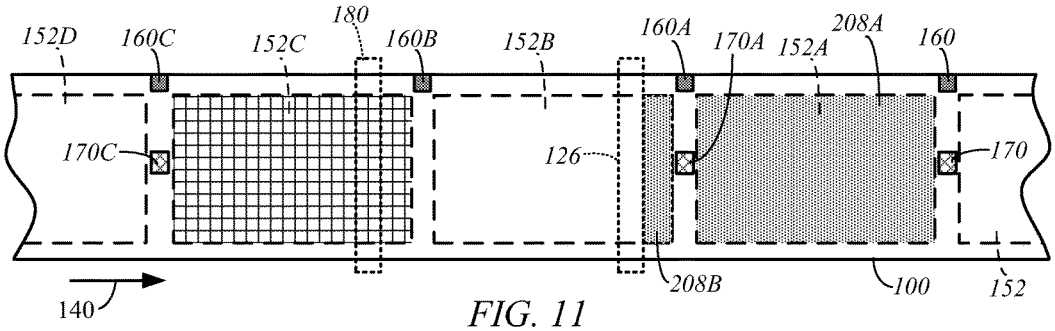

At 210 of the method, a used mark 170A corresponding to the selected and imaged transfer section 152A is printed using the print unit 124, during or following the completion of the printing of the image 208A, as illustrated in FIG. 11. After printing the used mark 170A, the method returns to 200 and the transfer ribbon 100 continues to be fed in the feed direction 140.

As mentioned above, some embodiments of the used marks 170 are printed on an upstream side of the used or unavailable transfer section 152, as illustrated by exemplary used marks 170A'-E' shown in FIG. 4. Accordingly, in some embodiments of the method, the printing steps 206 and 210 are reversed and the mark 170 corresponding to the selected transfer section 152A is printed on the transfer ribbon 100 on the upstream side of the selected transfer section 152A relative to the feed direction before the image 208A is printed to the selected transfer section 152A. That is, in some embodiments, following the selection of the transfer section 152A for a print operation using the controller 113, a used mark 170 corresponding to the selected transfer section 152A is printed on the transfer ribbon 100 at a location that is upstream from the selected transfer section 152A relative to the feed direction 140 using the print unit 124 (step 210), then the image 208A is printed to the selected transfer section 152A using the print unit 124.

Figure 12:
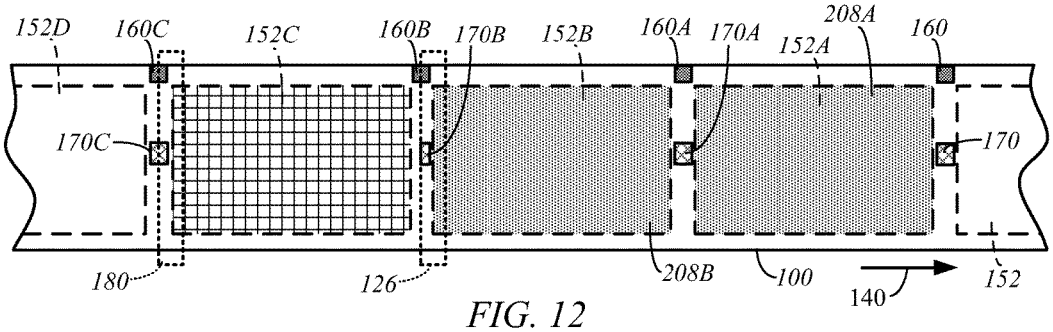
Figure 13:
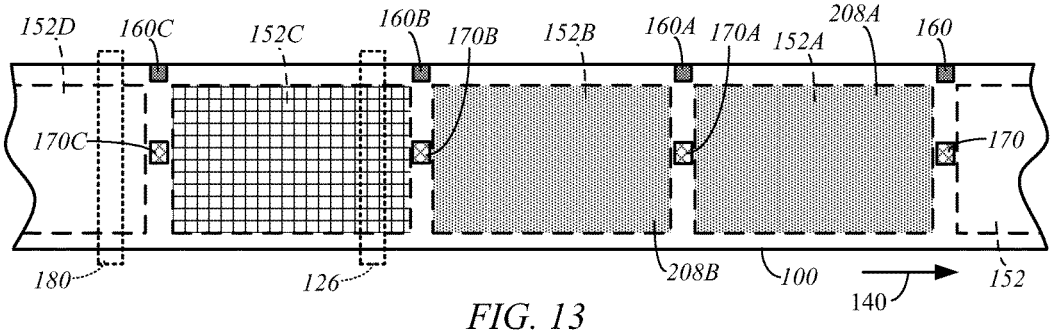

Following the printing steps 206 and 210, the controller 113 detects the registration mark 160B corresponding to the transfer section 152B using the mark sensor 180 to detect the candidate transfer section 152B (step 202), and the absence of a used mark 170 in the predetermined position relative to the candidate transfer section 152B using the mark sensor 180, at step 204 the method. As a result, the controller 113 selects the transfer section 152B for a printing operation, and an image 208B is printed to the selected transfer section 152B using the print unit 124, as illustrated in FIG. 11. A used mark 170B is printed to the transfer ribbon 100 using the print unit 124, during or following the completion of the printing of the image 208B, as indicated in FIGS. 11 and 12. The method then returns to step 200 where the transfer 100 continues to be fed in the feed direction 140.

As the transfer ribbon 100 is fed in the feed direction 140, the mark sensor 180 detects the candidate transfer section 152C (step 202) through the detection of the corresponding registration mark 160C, as illustrated in FIG. 12. At step 204, the controller 113 detects the used mark 170C corresponding to the candidate transfer section 152C using the mark sensor 180. The exemplary candidate transfer section 152C was previously processed in a print and/or transfer operation. As a result, a used mark 170C corresponding to the candidate transfer section 152C was previously printed in the predetermined position relative to the candidate transfer section 152C on the transfer ribbon 100 by the print unit 124 of the device 112, or the print unit of another transfer printing device. In response to this detection of the used mark 170C, the method returns to step 200 and the transfer ribbon 100 continues to be fed in the feed direction 140 to skip the candidate transfer section 152C, and start the method over with regard to the next transfer section 152D. As a result, the performance of a print and/or transfer operation using the transfer section 152C is prevented, thereby avoiding a potential malfunction and a defective print and/or transfer operation.

Additional embodiments of the present disclosure are directed a transfer printing device 112 formed in accordance with one or more embodiments described herein. In some embodiments, the device 112 includes the controller 113, the transfer unit 120, the print unit 124, and the mark sensor 180. The controller 113 controls the functions performed by the device 112 including one or more of the method steps described above. More specifically, the controller 113 may be configured to control the transfer unit 120 to perform transfer operations, the print unit 124 to perform print operations, motors of the device 112 (e.g. motors 138) to feed the transfer ribbon 100 and the print ribbon 128, and the transport mechanism 144 to feed the substrates 114, for example. In some embodiments, the controller 113 detects a candidate transfer section 152 through the detection of one or more registration marks 160 on the transfer ribbon 100 corresponding to the candidate transfer section 152 using the mark sensor 180. In some embodiments, the controller 113 detects the presence or absence of one or more used marks 170 on the transfer ribbon 100 corresponding to the candidate transfer section 152 using the mark sensor 180. When the controller 113 detects the absence of a used mark 170 in a predetermined position relative to the candidate transfer section 152, the controller 113 controls the print unit 124 to print an image to the selected transfer section 152, and to print one or more used marks 170 corresponding to the imaged transfer section 152 to the transfer ribbon 100. When the controller 113 detects the presence of a used mark 170 in the predetermined location relative to the candidate transfer section 152, the controller 113 continues to feed the transfer ribbon 100 in the feed direction 140 until the next candidate transfer section 152 is detected using the mark sensor 180.

Although the present invention has been described with reference to preferred embodiments, workers skilled in the art will recognize that changes may be made in form and detail without departing from the spirit and scope of the present disclosure.

COPYRIGHT AND LEGAL NOTICES

A portion of the disclosure of this patent document contains material which is subject to U.S. copyright protection. The copyright owner has no objection to the facsimile reproduction by anyone of the patent document or the patent disclosure, as it appears in the United States Patent and Trademark Office patent files or records, but otherwise reserves all copyrights whatsoever.

What is claimed is:

1. A method of operating a transfer printer having a transfer ribbon, a print unit, and a mark sensor, the transfer ribbon including a series of transfer sections, the method comprising steps of:

feeding the transfer ribbon in a feed direction;

selecting a transfer section that is available for printing comprising detecting an absence of a used mark in a predetermined position on the transfer ribbon corresponding to the transfer section using the mark sensor;

printing an image to the selected transfer section using the print unit; and printing a used mark corresponding to the selected transfer section in a predetermined position on the transfer ribbon.

2. The method according to claim 1, further comprising determining that a candidate transfer section is not available for printing comprising detecting a used mark in the predetermined position corresponding to the candidate transfer section using the mark sensor.

3. The method according to claim 1, wherein:

the transfer ribbon includes a plurality of registration marks, each registration mark corresponding to one of the transfer sections; and the method comprises detecting one or more of the transfer sections including detecting the registration marks corresponding to the one or more transfer sections.

4. The method according to claim 3, wherein detecting the registration marks comprises detecting the registration marks using the mark sensor.

5. The method according to claim 3, wherein the predetermined position is displaced from the registration mark corresponding to the selected transfer section in a direction that is perpendicular to the feed direction.

6. The method according to claim 3, wherein detecting the registration marks comprises detecting the registration marks using a registration mark sensor that is different from the mark sensor.

7. The method according to claim 1, further comprising transferring the image from the selected transfer section to a substrate using a transfer unit.

8. The method according to claim 1, wherein the predetermined position is just after the selected transfer section.

9. The method according to claim 1, wherein the predetermined position is between the selected transfer section and a transfer section that adjoins the selected transfer section.

10. The method according to claim 1, wherein the used mark is printed before printing an image to the selected transfer section using the print unit.

11. The method according to claim 1, wherein the used mark is printed after printing an image to the selected transfer section using the print unit.

12. The method according to claim 1, wherein detecting an absence of a used mark comprises transmitting light at the transfer ribbon using the mark sensor.

13. A method of printing using a transfer printer having a transfer ribbon, a print unit, and a mark sensor, the transfer ribbon including a series of transfer sections, the method comprising steps of:

detecting a candidate transfer section using the mark sensor;

detecting one of a used mark in a predetermined position corresponding to the candidate transfer section or an absence of the used mark using the mark sensor;

feeding the transfer ribbon in a feed direction and repeating the detecting steps when the used mark is detected;

selecting the candidate transfer section for printing when the absence of the used mark is detected;

printing an image to the selected transfer section using the print unit; and printing a used mark corresponding to the selected transfer section in a predetermined position on the transfer ribbon using the print unit.

* * * * *